US006569493B2

(12) United States Patent
Lokant

(10) Patent No.: US 6,569,493 B2
(45) Date of Patent: May 27, 2003

(54) METHOD OF REPAIRING A PAPER MACHINE DRYER JOURNAL MOISTURE BARRIER

(75) Inventor: Frank Joseph Lokant, White Sulphur Springs, WV (US)

(73) Assignee: Mead Westvaco Corporation, Stamford, CT (US)

( * ) Notice: Subject to any disclaimer, the term of this patent is extended or adjusted under 35 U.S.C. 154(b) by 0 days.

(21) Appl. No.: 10/141,307

(22) Filed: May 7, 2002

(65) Prior Publication Data

US 2002/0185241 A1 Dec. 12, 2002

Related U.S. Application Data

(63) Continuation-in-part of application No. 09/571,371, filed on May 15, 2000, now abandoned.

(51) Int. Cl.[7] ..... B05D 7/14; B05D 7/22

(52) U.S. Cl. ..... 427/142; 427/140; 427/230; 162/199; 162/272; 277/356; 277/316; 277/314; 277/936; 277/938; 277/946; 285/14; 285/15; 285/47; 285/294.1; 285/296.1

(58) Field of Search ..... 427/140, 142, 427/230; 162/199, 272; 277/356, 316, 314, 936, 938, 946; 285/14, 15, 47, 294.1, 296.1

(56) References Cited

U.S. PATENT DOCUMENTS

| | | | | |
|---|---|---|---|---|
| 2,886,901 A | | 5/1959 | Whyte et al. | |
| 3,097,994 A | | 7/1963 | Dickens et al. | |
| 3,685,546 A | * | 8/1972 | Sigmund | 285/47 |
| 3,875,686 A | | 4/1975 | Smoot | |
| 4,069,596 A | | 1/1978 | Sisler | |
| 4,076,582 A | | 2/1978 | Burkhart | |
| 4,348,819 A | | 9/1982 | Gamble | |
| 4,707,222 A | | 11/1987 | Müllner et al. | |
| 4,716,661 A | | 1/1988 | Asman | |
| 4,834,884 A | | 5/1989 | Berglöff et al. | |
| 4,915,787 A | | 4/1990 | Branyon et al. | |
| 4,975,150 A | | 12/1990 | Yasuda et al. | |
| 5,154,009 A | | 10/1992 | Kade et al. | |
| 5,360,519 A | | 11/1994 | Scarano | |
| 5,363,569 A | | 11/1994 | Kadakia | |
| 5,463,883 A | | 11/1995 | Pellerin et al. | |
| 5,554,263 A | | 9/1996 | Laakko | |
| 5,843,282 A | | 12/1998 | Schmitt et al. | |
| 5,900,120 A | | 5/1999 | Graf | |
| 6,095,784 A | * | 8/2000 | Wickizer | 425/11 |

* cited by examiner

*Primary Examiner*—Shrive P. Beck
*Assistant Examiner*—Jennifer Kolb Michener
(74) *Attorney, Agent, or Firm*—D. L. Bowman

(57) ABSTRACT

This invention relates to a method of repairing a moisture barrier separating a paper machine dryer drum from the dryer journal. Such processes of this type, generally, involve filling the cavity between the dryer drum steam intake pipe and the dryer journal with a flowable moisture barrier material. The flowable moisture barrier seals leaks in the dryer journal moisture barrier.

7 Claims, 2 Drawing Sheets

18

METHOD OF REPAIRING A PAPER MACHINE DRYER JOURNAL MOISTURE BARRIER

CROSS-REFERENCE TO RELATED APPLICATIONS

The present application is a continuation in part application of Ser. No. 09/571,371, filed May 15, 2000, now abandoned.

BACKGROUND OF THE INVENTION

1 Field of the Invention

This invention relates to a method of repairing the moisture barrier separating a paper machine dryer drum from the dryer journal. Such processes of this type, generally, involve substantially filling the air cavity between the dryer steam intake pipe and the dryer journal with a flowable moisture barrier.

2 Description of the Prior Art

In conventional paper making machines several large dryer drums or heated cylinders are located near the end of the paper machine. The dryer drums are conventionally filled with steam at approximately 200 to 300 F degrees under pressure. The dryer drums contact both sides of the paper web and reduce the paper's water content to approximately 5%. The dryer drums are typically 5 feet wide or wider and typically weigh in excess of 2 tons. Each drum end is supported by a journal head. Each journal head is further supported by a journal assembly at each end.

Figure 1:
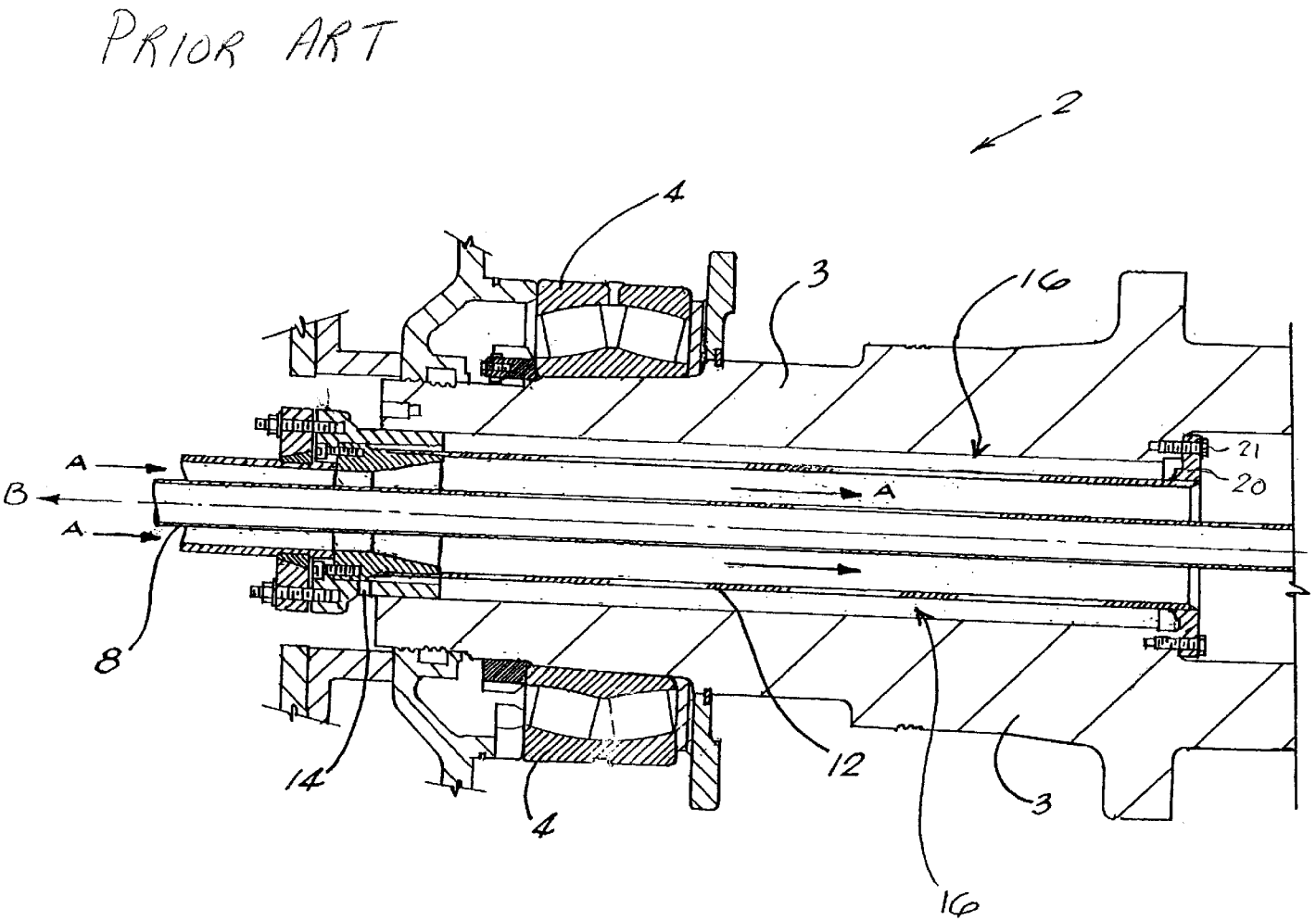
PRIOR ART FIGURE 1

FIG. 1 is a cross-sectional drawing of a prior art journal assembly 2. The journal assembly 2 acts as an axle to rotate the dryer drum (not shown) about a central axis. The journal assembly 2 typically has a hollow, annular main journal body 3, hereinafter referred to as the journal. The journal 3 is supported by and rotated via journal bearings 4. The bearings 4 are typically located in a housing. U.S. Pat. No. 4, 716, 661 by Asman is an exemplary reference of a hollow, annular journal for a paper machine dryer. Typically the dryer drum steam intake pipe 12 is placed into the hollow portion of the journal 3 as shown in FIG. 1. Typically, steam enters into the dryer drum in the direction of arrow A. Typically a steam condensate pipe 8 is located internal to the steam intake pipe 12. In such cases, the steam condensate exits the dryer drum in the direction of arrow B.

A thin annular cavity 16 separates the dryer steam intake pipe 12 from the journal 3. This air cavity, primarily, serves as a heat insulator between the dryer steam intake pipe 12 and the journal 3. The cavity eliminates most heat transfer from the steam intake pipe 12 to the journal bearings 4.

Conventionally a journal moisture barrier 20 is used to prevent steam from leaving the dryer drum and entering the cavity 16. Typically, the journal moisture barrier 20 is an annular flange with a polymeric coating-based material or other moisture barrier, such as a rubber gasket. The journal moisture barrier is typically secured to the journal 3 by bolts 21 so that the polymeric coating touches the journal 3. However, conventional journal moisture barriers 20 often fail to withstand the high temperatures of the dryer steam that can reach as high as 390° F. Frequently, the journal moisture barrier 20 breaks down or develops a leak that allows moisture from the dryer drum to enter the cavity 16. As high temperature moisture enters the cavity 16 unacceptable amounts of heat are transferred through the journal 3 to the journal bearings 4. High temperature moisture leaks adversely impacts the journal 3 and the bearings 4. The moisture can cause the journal's 3 metal surface too pit and can breakdown the bearing's 4 lubrication (not shown) and lubrication system (not shown). Typically a leak in the journal moisture barrier 20 is detected by moisture exiting the cavity 16 via an opening 14, such a weep hole.

It is known to replace conventional journal moisture barriers 20 when they break down or leak. However, this requires many man-hours of labor and downtime for the entire paper machine to replace one moisture barrier, which ultimately leads to reduced paper production. An exemplary description of a conventional replacement or repair method is described in U.S. Pat. No. 4, 716, 661, column 4, lines 55–70. A typical paper machine includes many dryer journal moisture barriers 20 so the potential maintenance cost and paper machine downtime is great. Also, simply replacing one conventional journal moisture barrier 20 with another does not eliminate future replacements. Therefore, a more advantageous repair method for damaged journal moisture barriers 20 is highly desirable.

It is apparent from the above that there exists a need in the art for a method to quickly and cost effectively repair a paper machine dryer journal moisture barrier. It is a purpose of this invention to fulfill this and other needs in the art in a manner more apparent to the skilled artisan once given the following disclosure.

SUMMARY OF THE INVENTION

Generally speaking, this invention fulfills these needs by providing a method to repair a moisture barrier separating a paper machine dryer drum from the dryer journal. The air cavity located between the dryer steam intake pipe and the dryer journal is filled with a flowable moisture barrier. The flowable moisture barrier in the cavity seals any leaks in the journal moisture barrier.

The above and other advantages, features and benefits of the present invention will become more apparent by considering the following detailed description and drawings.

A BRIEF DESCRIPTION OF THE DRAWINGS

Figure 2:
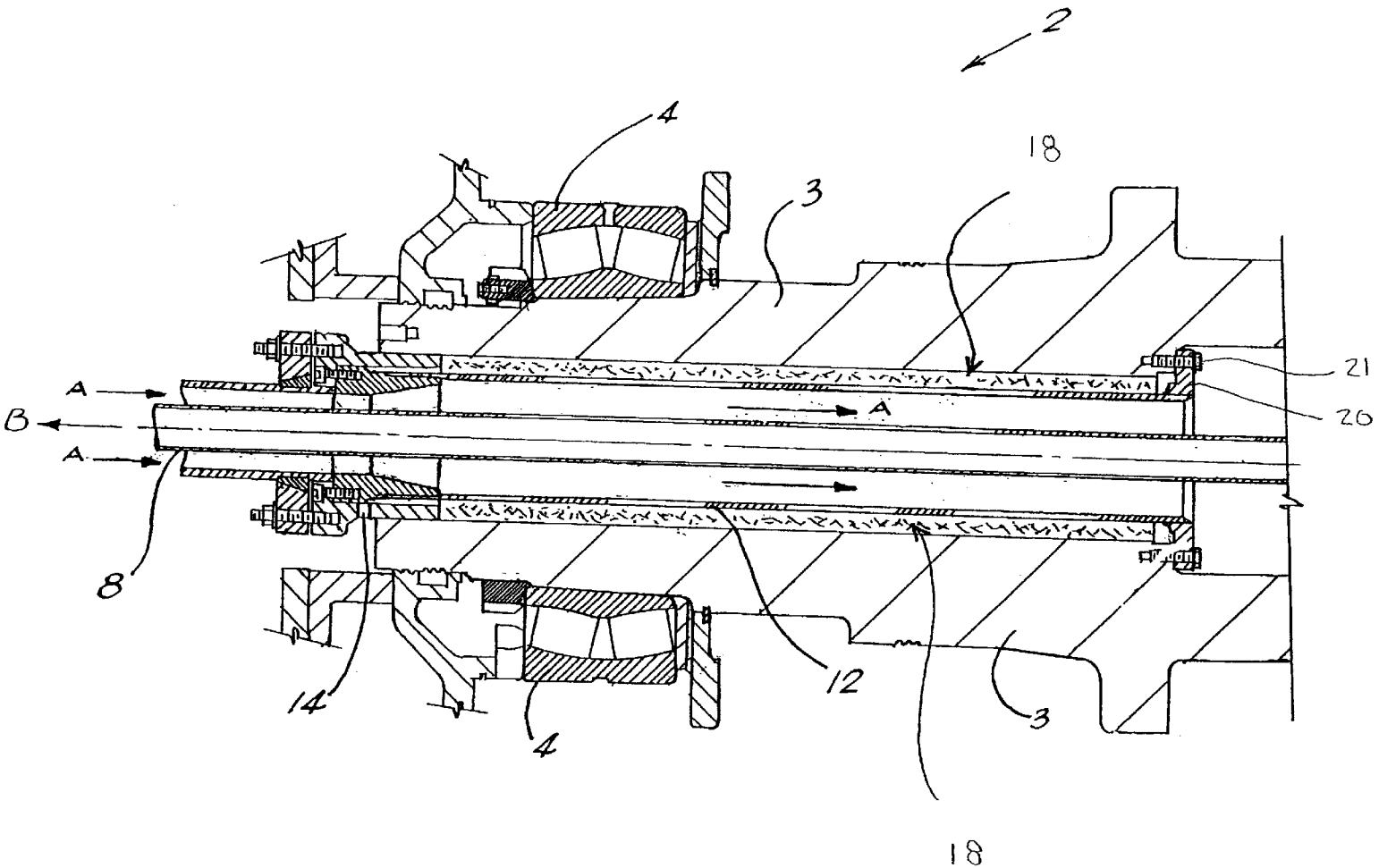

FIG. 1 is a prior art, side, cross-sectional view or a paper machine dryer journal with a conventional moisture barrier; and FIG. 2 is a side, cross-sectional view of a paper machine dryer journal with a repaired moisture barrier according to the present invention.

DETAILED DESCRIPTION OF THE INVENTION

With Reference to FIG. 2, a leak in the dryer journal moisture barrier 20 typically occurs every 6 to 24 months. In order to repair the moisture barrier 20, the entire paper machine must be shut down. In an exemplary embodiment according to the invention, the cavity 16 of FIG. 1, which separates the dryer journal 3 from the dryer drum steam intake pipe 12 can be filled with a flowable moisture barrier 18 (FIG. 2). The flowable moisture barrier 18 seals any damaged areas, such as for example steam leaks, in the journal moisture barrier 20.

In an exemplary embodiment, the flowable moisture barrier 18 is placed in the cavity 16 (FIG. 1) while the paper making machine is shut down. The repair method according to the present invention is much faster and cheaper than conventional methods. No worker entry into the dryer drum is required and the overall speed of the repair is much greater. In addition, if shut down, the papermaking machine can be returned to operation much sooner than under conventional moisture barrier repair methods. It is to be understood that the scope of the invention is not limited to repairs made while the machine is shut down. The invention covers filling cavity 16 during machine operation.

The flowable moisture barrier 18 must be able to flow from an opening 14 in the cavity 16 such as weep hole 14 or any other cavity opening to the journal moisture barrier 20. The flowable moisture barrier 18 is ideally paste-like with a cure time of 1 hour or less. The flowable moisture barrier 18 must be able to withstand potential temperatures of up to 500 degrees F. The cavity opening 14 can be permanently or temporary sealed after the flowable moisture barrier 18 has been placed in the cavity 16. Exemplary flowable moisture barrier 18 materials include pastes such as PVR manufactured in Luke, Md. In addition the barrier 18 can contain fibers, thermosetting organic resins, graphite or Teflon ® based compounds containing polytetrafluoroethylene (PTFE).

In order to demonstrate the problem solved by the present invention, temperature readings of several locations of the journal assembly 2, for both non-leaking and leaking conventional journal moisture barriers 20, were taken, as shown below in the following TABLE.

TABLE

| Condition of Journal Moisture Barrier | Outside Temperature of Steam Intake Pipe | Temperature of Journal Bearing Housing |
|---|---|---|
| 1. Journal Moisture Barrier not leaking | 251° F. | 190° F. |
| 2. Journal Moisture Barrier leaking | 250° F. | 208° F. |

The table displays the temperature at both the outside of the dryer drum steam intake pipe 12 and the housing of the journal bearing 4 for both leaking and non-leaking conditions of the journal moisture barrier 20. Item 1 displays the temperature at the two locations when the dryer journal moisture barrier 20 is not leaking. Item 2 displays the temperature at the two locations when the dryer journal moisture barrier 20 is leaking; i.e. when steam is entering into cavity 16. The journal bearings 4 experiences temperatures over 18 degree higher when the journal moisture barrier 20 is leaking.

For a journal moisture barrier 20 repaired according to the method of the invention, an exemplary temperature difference of 54 degrees was measured between the journal bearing 4 versus the temperature of the steam intake pipe 12. This temperature was in the range expected for a non-leaking journal moisture barrier as demonstrated in item 1. The repair according to the invention resulted in acceptable temperature ranges for the journal bearings 4. As discussed above, this reduction in heat at the journal bearing 4 improves the operational efficiency of the journal bearing 4.

Once given the above disclosure, many other features, modifications or improvements will become apparent to the skilled artisan. Such features, modifications or improvements are, therefore, considered to be a part of this invention, the scope of which is to be determined by the following claims.

What is claimed is:

1. A method of repairing a paper machine dryer journal moisture barrier comprising the step of substantially filling a cavity located between a dryer steam intake pipe and the dryer journal with a flowable moisture barrier material such that said materials substantially covers any damaged areas of the existing journal moisture barrier.

2. The method as in claim 1, wherein said flowable moisture barrier material comprises graphite.

3. The method as in claim 1, wherein said flowable moisture barrier material comprises Polytetrafluoroethylene (PTFE).

4. The method as in claim 1, wherein said flowable moisture barrier material comprises thermosetting, organic resins.

5. The method as in claim 1, wherein said flowable moisture barrier material is a non-gas at a temperature of less than about 500° F.

6. The method of claim 1, wherein said flowable material is inserted into the cavity through the cavity weep hole.

7. The method of claim 6, wherein said opening is permanently closed after the flowable moisture barrier is inserted into the cavity.

* * * * *